US005860714A

United States Patent [19]

Skord, Jr.

[11] Patent Number: 5,860,714

[45] Date of Patent: Jan. 19, 1999

[54] VANDAL-PROOF VENDING MACHINE

[76] Inventor: Charles Robert Skord, Jr., 400 Forest Beach Rd., Annapolis, Md. 21401

[21] Appl. No.: 838,160

[22] Filed: Apr. 16, 1997

[51] Int. Cl.[6] ..... A47F 3/00

[52] U.S. Cl. ..... 312/242; 312/4; 312/35; 312/124; 312/249.8; 52/212

[58] Field of Search ..... 312/3, 4, 5, 35, 312/114, 117, 124, 138.1, 242, 249.8, 297; 52/212, 211, 204.54, 204.53, 204.63, 656.6, 65; 49/42, 104, 125, 381

[56] References Cited

U.S. PATENT DOCUMENTS

| | | | |
|---|---|---|---|
| 1,035,015 | 8/1912 | Johnson | 312/114 |
| 2,808,610 | 10/1957 | Minor | 312/321.5 X |
| 2,915,960 | 12/1959 | McClellan, Jr. | 312/242 X |
| 2,970,026 | 1/1961 | Smith | 312/35 |
| 3,344,953 | 10/1967 | Krakauer et al. | 312/35 X |
| 3,434,249 | 3/1969 | Richey | 52/65 |
| 3,994,243 | 11/1976 | Anders | 52/212 X |
| 4,073,093 | 2/1978 | Ookawa et al. | 49/381 |
| 4,179,849 | 12/1979 | Kuffner | 52/212 X |
| 4,196,953 | 4/1980 | Krakow . | |
| 4,590,723 | 5/1986 | Nassau et al. | 52/204.53 |
| 4,973,109 | 11/1990 | Diedrich | 312/114 |
| 5,372,416 | 12/1994 | Shapley et al. | 312/138.1 |
| 5,713,167 | 2/1998 | Durham et al. | 52/204.54 |

*Primary Examiner*—Jose V. Chen
*Assistant Examiner*—Hanh V. Tran
*Attorney, Agent, or Firm*—Diller, Ramik & Wight, PC

[57] ABSTRACT

A vandal-proof vending machine includes a rigid frame housed within an opening of a building with a cabinet of the dispensing machine being housed entirely within the building and thereby being rendered inaccessible from the exterior. A front opening of the frame to which products housed in an interior of the cabinet can be viewed is protected by a laminate of tough transparent material and tough metal mesh. The cabinet has rollers at a bottom thereof and one corner is secured by pivots to a side of the frame. The cabinet can thereby be rolled between a closed dispensing position and an opened servicing position.

40 Claims, 4 Drawing Sheets

So
W
27
23
28
22
Eu
59
58
64
10
90
30
7
72
59
7
62
63
P
59
54
28
S
59
62
25
20
63
10
59
73
36
64
P
42
37
38
58
59
Eℓ
0
22
28
24
27
So
W
Si

21
A
10
30
32
45
43
44
42
41
43
44
42
43
40
26

30
36
59
22
64
38
42
P
59
58
0
20
24
53
27
28
Eℓ

VANDAL-PROOF VENDING MACHINE

BACKGROUND OF THE INVENTION

Vending machines have been used for many years to dispense a variety of different products, as evidenced by any one or all of the patents to J. T. Schuller (U.S. Pat. No. 3,178,055), Donald C. Rockola et al. (U.S. Pat. No. 4,886,325), Charles L. Casey (U.S. Pat. Nos. 2,316,315 and 2,352,471), and Leonard A. Ficken (U.S. Pat No. 4,823,984).

Typically, a conventional vending machine includes a housing for storing the articles which are to be dispensed and a conventional dispensing mechanism which can be accessed through conventional coin/token/card/paper money acceptors. Such vending machines can be filled through either a front or a rear access door and the dispensed articles are normally dispensed through a front dispensing guide and/or dispensing opening. Usually, the products or articles can be containers or soft drinks or the like, food products, candy bars, snack foods, or specific products associated with specific activities which occur at the dispensing area, such as vending machines for dispensing automobile protectant, such as Armor All®, towels, glass cleaner, and similar products at vehicle car washes. No matter the specific type of vending machine involved or its area of location, one major problem is vandalism and theft. It is not uncommon for vending machines to be left unattended and thus they are subject to theft and/or damage. Even if vandals do not successfully steal the products/articles and/or money from within a vending machine, the unsuccessful theft is emotionally disconcerting to a thief and his/her unsuccessful effort at theft turns into malicious assaults upon the associated vending machine. Vending machines have been beaten with sledge hammers, torn with crow bars, axed, tipped over, dragged for miles and discarded, etc., all resulting in loss of time, money and effort to the vendor.

A variety of vending machine securing cages/systems are known, such as the vending machine security cage of U.S. Pat. No. 4,418,551 and the vending machine security system of U.S. Pat. No. 5,108,166, and the numerous patents cited in the first column of the latter patent. More pertinent to the present invention is the vending machine of U.S. Pat. No. 5,372,416 which includes a vending machine whose product display/storage area is conventionally closed by a door, but the latter is covered by an impact panel in the form of a separate translucent window which is internally mounted to the door frame adjacent the viewing area. The transparent panel is a sheet of Lexon® which is essentially indestructible and is designed to prevent access to the dispensable product/articles through the viewing area of the dispensing machine. Though this vandal-proof door generally prevents access to the vending machine interior and the products therein through the viewing area, the protection afforded to the viewing area has no consequence insofar as the overall vending machine integrity is concerned. Thus, a thief might choose not to attempt to break the impact panel but instead "jimmy" the access door or, failing in the latter, allow frustration to dictate subsequent vending machine destruction/damage in the manner earlier described.

SUMMARY OF THE INVENTION

In keeping with the foregoing, the present invention provides a novel vandal-proof vending machine in which a conventional vending machine of virtually any type is housed within an internal structure, such as a conventional cinder block and/or brick building adjacent to a car wash. The vending machine is located entirely located within the building, but the interior of the vending machine is viewable through an opening formed in a wall of the building and the products/articles can be dispensed through this opening. Thus, the vending machine is entirely housed within the building and is totally unaccessible to a thief/vandal.

The opening in the building is provided with a relatively rigid, strong, metal, polygonal frame and a lateral or side edge of the vending machine is pivotally mounted to the frame for pivoting movement along a vertical axis. A "front" of the vending machine is open and this open front defines the viewing area in which the dispensable products/articles are housed. In one position the vending machine is pivoted and rolled upon lower rollers to a vending position at which its front immediately adjacent the frame and is locked thereat. This is the dispensing position of the vending machine. In a second position, the entire vending machine is pivoted and rolled away from the frame and the building wall and this is the open inspection, filling, money collecting, servicing, etc. position. Thus, in one aspect of the invention the entire vending machine is protected by being entirely housed within a relatively strong building structure.

In further accordance with the invention, a product-viewing area containing dispensable products/articles which are viewed through the opening of the building wall is covered by a polygonal outer frame member of strong, rigid, tough metal having an opening which is in turn covered by a tough transparent panel of Lexon® or a similar polymeric/copolymeric material. A panel of high strength mesh metallic material is inboard of the transparent panel with the two panels defining a generally destruction-proof laminate through which dispensable products can be viewed, yet accessibility thereto is prevented.

A flat polygonal plate in part defines the outer frame member and an interior polygonal frame member is defined by a plurality of angle bars welded to each other in conformity with the opening in the building. The polygonal plate has additionally welded thereto upper, lower and side plates which are in turn welded to upper, lower and side flanges, respectively, of the inner frame member. The vending machine is pivotally connected to this rigid frame, again within the interior of the building. Thus, though the vending machine is readily accessible interiorly of the building, particularly when pivoted to its open position for servicing, maintenance, repair or product filling, the entirety of the vending machine is virtually totally unaccessible from the exterior of the building. Thus, the vending machine is essentially vandal-proof.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 2:
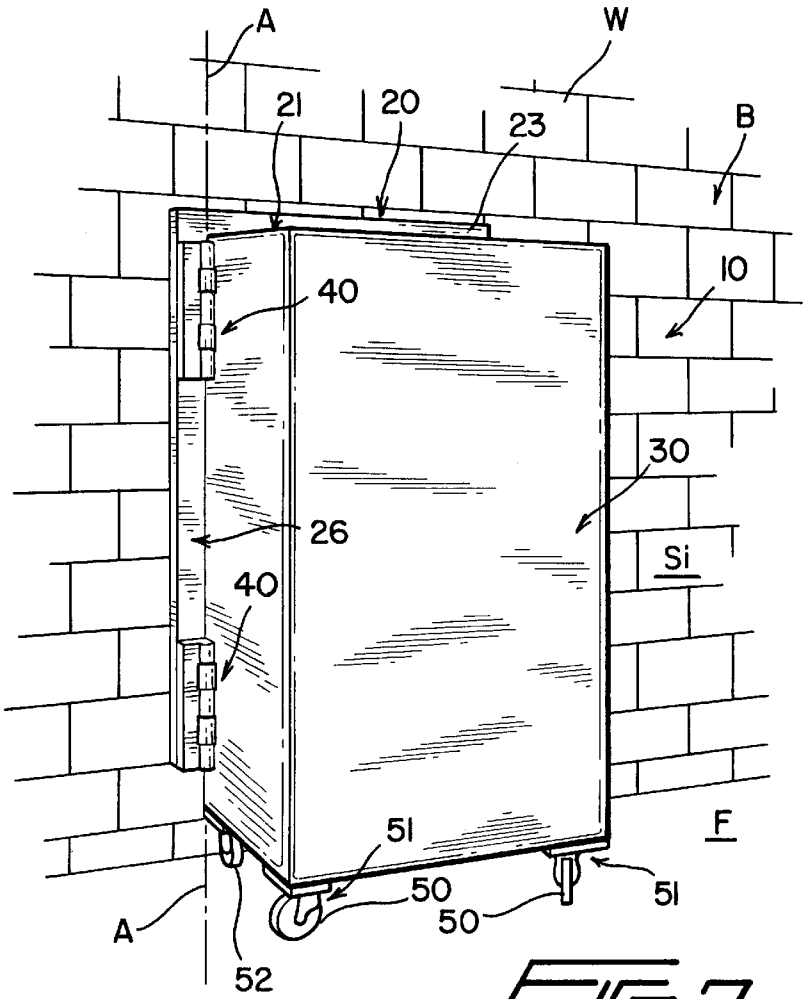
FIG. 2 is a rear perspective view of the vandal-proof vending machine in its dispensing position, and illustrates the same supported by rollers and pivotally connected to an interior frame member of a frame associated with an opening of a wall of the building.

A novel vandal-proof vending machine constructed in accordance with this invention is generally designated by the reference numeral 10.

Figure 1:
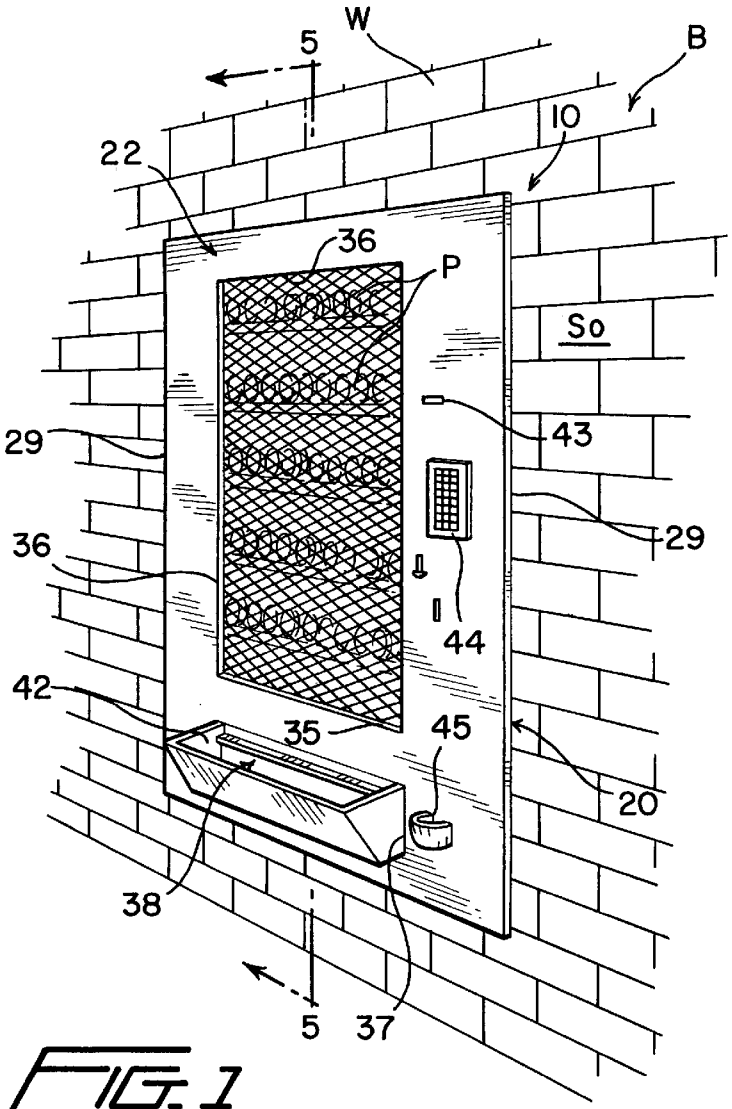
FIG. 1 is perspective view of a novel vandal-proof vending machine of the present invention in its dispensing position associated with a building, and illustrates an exterior polygonal front plate or frame member having an opening covered by an exterior tough transparent panel and an inboard tough metallic mesh panel through both of which articles/products which are to be dispensed can be readily viewed.
Figure 3:
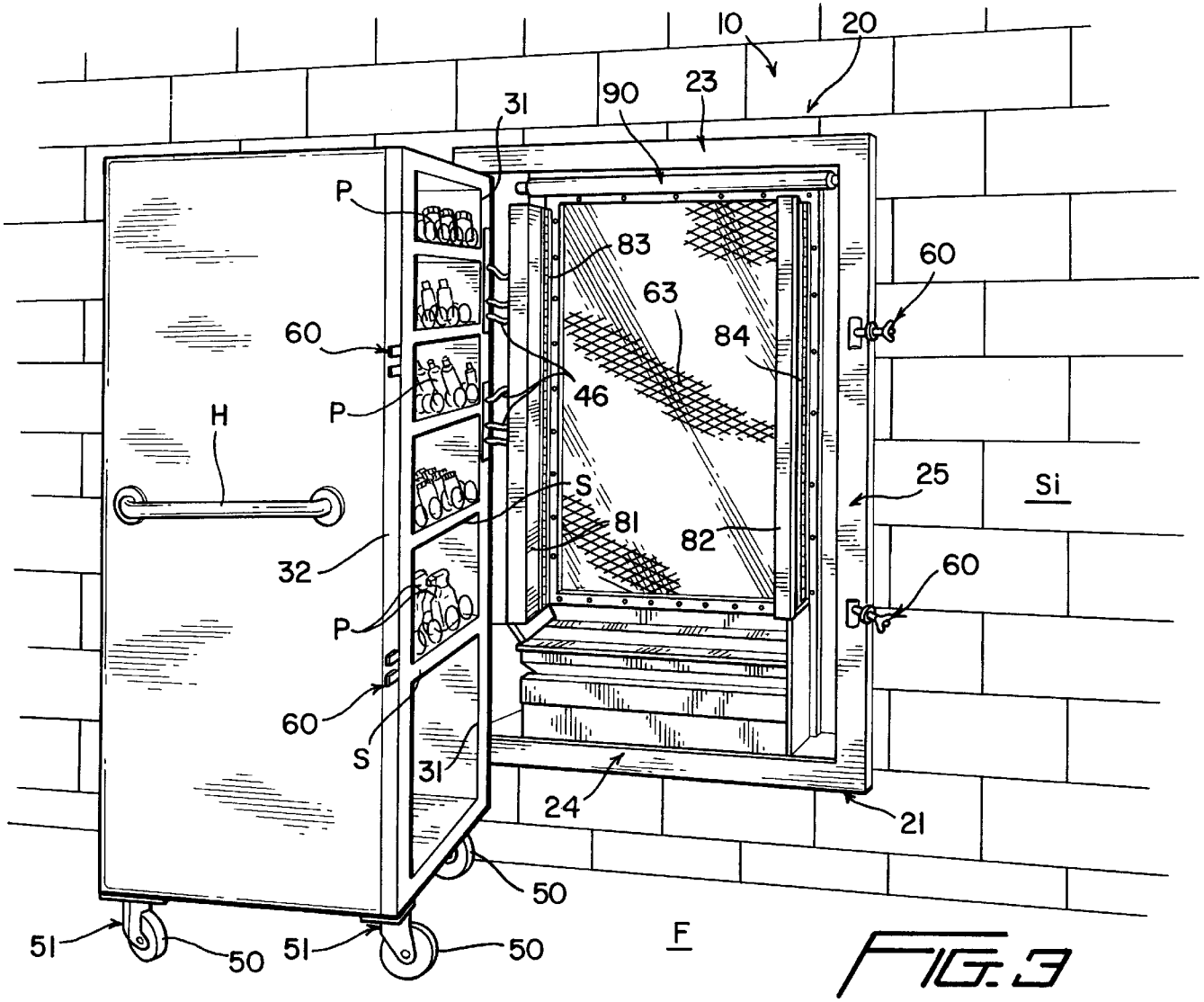
FIG. 3 is a perspective view similar to FIG. 2, and illustrates a housing or cabinet of the vending machine rolled or pivoted to its open servicing position in which products can be loaded and a coin/token acceptor mechanism and coin/token box, etc. can be accessed.

The vending machine 10 is illustrated in FIGS. 1 through 3 of the drawings in relationship to a wall W of a building B. The building B is a building which has a functional relationship and a geographic proximity to activities involving particular products or articles P (FIGS. 1, 3 and 5) which are to be dispensed from the vending machine 10. For example, in the specific preferred embodiment of the present invention, the building B could be a garage or office associated with a so-called self-serve car wash which might include one or more bays each having a high pressure wash/rinse wand or nozzle and often times a wash brush having a hollow handle connected to a source of soapy water. During such manual wand/brush washing activities, the user at times requires additional soap, cloths, glass cleaner (for vehicle windshields), protectant (for tires, upholstery, dashboards and the like), etc. The latter are the type of products P which can be dispensed from the vending machine 10 in a conventional manner. Particular products P and the specifics of the dispensing mechanisms, the coin/token acceptors, etc. are all conventional and the specifics thereof are unrelated to the present invention. However, as an example, the vending machine 10 may have a vending mechanism corresponding to that disclosed in U.S. Pat. No. 5,372,416 granted on Dec. 13, 1994 to David A. Shapley et al.

Figure 6:
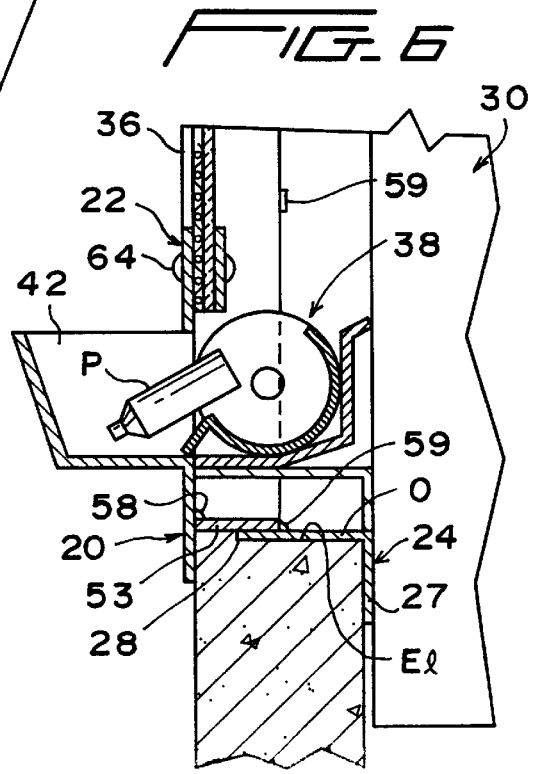
FIG. 6 is a fragmentary cross sectional view of the lower portion of FIG. 5, and illustrates a product being dispensed upon the product-receiving tray.
Figure 7:
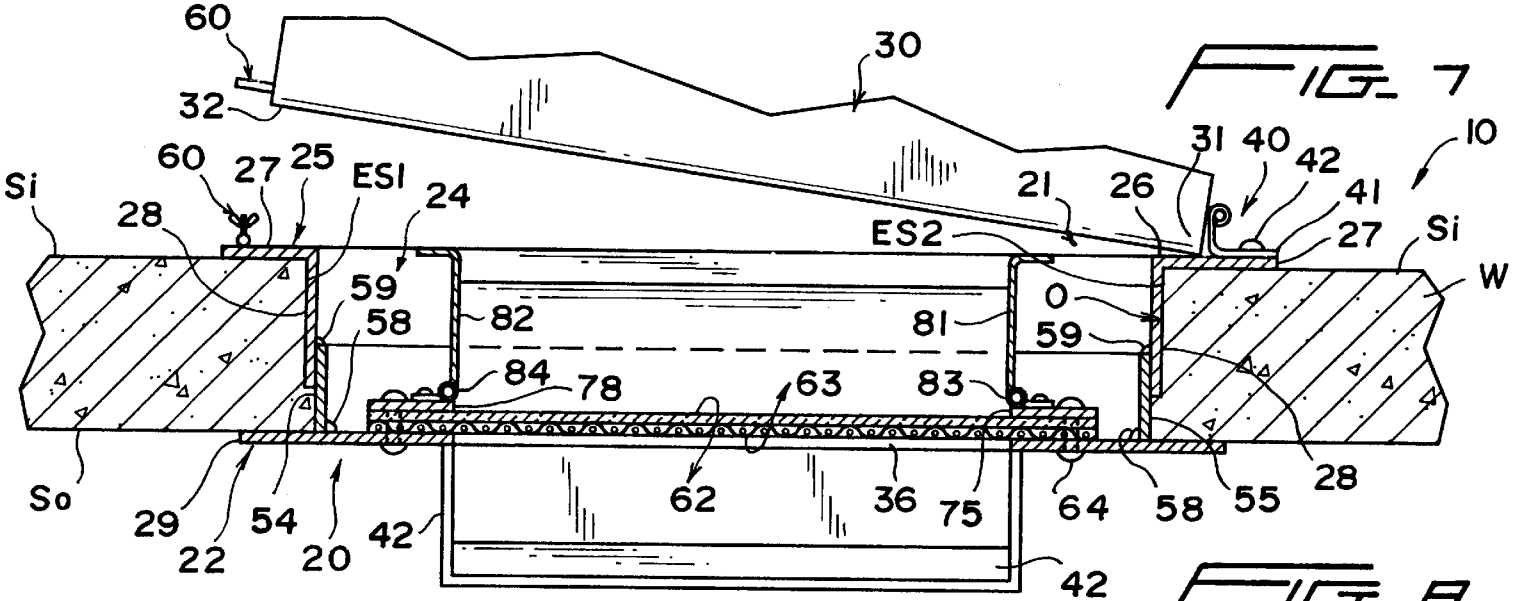
FIG. 7 a cross-sectional view taken generally along line 7—7 of FIG. 5, and illustrates details of the frame, two side product-guiding panels, and the housing or cabinet of the vending machine partially pivoted away from the building wall.
Figure 8:
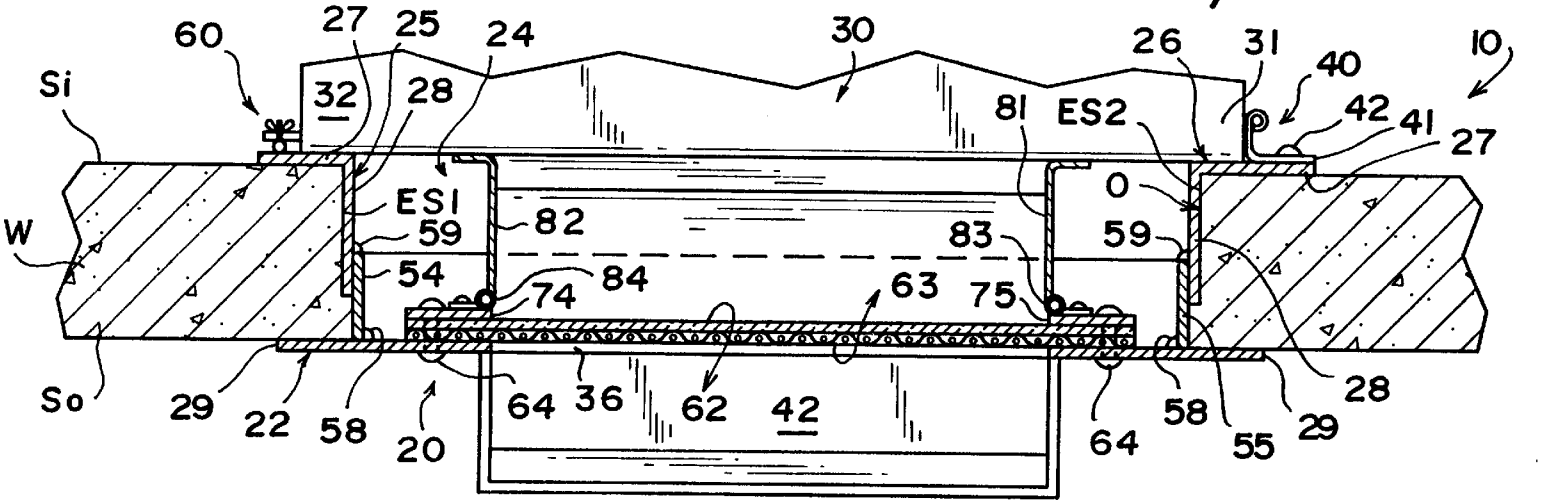
FIG. 8 is a cross-sectional view identical to FIG. 7, and illustrates the vending machine housing or cabinet in its closed vending position and releasably locked thereat.

The wall W could be constructed from cinder block, cinder block and brick, wood or the like, and includes an outer surface So (FIG. 1) and an inner surface Si which merges with an interior floor F (FIGS. 2 and 3). An opening O (FIGS. 5 through 8) is formed in the wall W and opens through the surfaces S1, S2. The opening O is of a generally polygonal configuration and is defined by a lower edge El (FIGS. 5 and 6), an upper edge Eu (FIG. 5) generally parallel to the lower edge El, and opposite generally parallel side edges $Es_1$ and $Es_2$ (FIGS. 7 and 8). As will be described more fully hereinafter, a substantially tough and rigid frame or frame means 20 constructed of metal material is intimately and permanently secured to the wall W generally within and in surrounding relationship to the opening O.

Housing means or a cabinet 30 of the vending machine 10 is united in pivotal rolling relationship to the frame 20 by identical pivots 40 (FIGS. 2, 4, 7 and 8) which permit the cabinet 30 to be rolled about a generally vertical pivot axis A (FIGS. 2 and 4) defined by the pivots 40 and rolled upon conventional roller means or rollers 50 which are part of conventional casters 51 welded or otherwise secured at each bottom corner (unnumbered) of the cabinet 30. The pivots 40, 40 and the rollers 50 permit the cabinet 30 to be moved from its vending or dispensing position (FIGS. 1, 2, 5, 6 and 8) which is a "closed" position relative to the frame 20 and the inner surface Si of the wall W and an open servicing position (FIG. 3) which allows products P to be replenished and other maintenance and related activities performed, as is customary in the vending machine business, such as accessing the coin/token collection box, checking the change supply, validating the product inventory against coin/token deposits, etc. A handle H (FIG. 3) secured to the cabinet 30 facilitates the pivoting/rolling movement of the cabinet 30 between the open and closed positions. Additionally, the cabinet 30 includes two opposite vertical forward corners 31, 32, the former of which has secured thereto the pivots 40, 40, as will be described more fully hereinafter, and the latter in part carrying means 60 (FIGS. 3, 7 and 8) for releasably locking the cabinet 30 in its closed position (FIG. 8).

The frame 20 includes an inner generally polygonal frame member 21 and an outer generally polygonal frame member 22 (FIGS. 2 and 1, respectively). The inner frame member 21 is defined by four metal angle iron members, namely, an upper angle iron member 23 (FIGS. 2 and 5), a lower angle iron member 24 (FIGS. 5 through 8), a first side angle iron member 25 (FIGS. 5 through 8) and a second side angle iron member 26 (FIGS. 7 and 8) which is parallel to the first side angle iron member 25 (FIGS. 7 and 8). Each of the angle iron members 23 through 25 is defined by a pair of flanges 27, 28 disposed normal to each other. The flanges 27 of each of the inside angle iron members 23 through 26 bear against the inside surface Si (FIGS. 7 and 8) of the wall W. The flanges 28 of the first and second side angle iron members 25, 26, respectively, bear against the respective first side edge $Es_1$ and second side edge $Es_2$ of the opening O. The flange 28 of the lower angle iron member 24 bears against the lower edge El of the opening O (FIG. 6), while the flange 28 of the upper angle iron member 23 bears against the upper edge Eu (FIG. 5) of the opening (O).

The outer frame member 22 is of a generally polygonal configuration having an outer edge 29 and an inner edge 35 of a polygonal configuration defining a polygonal opening 36. A lower rectangular opening 37 (FIGS. 1, 5 and 6) includes a conventional rotatable dispensing roll 38 (FIGS. 4 and 5) immediately adjacent thereto through which a product/article P (FIGS. 5 and 6) can be dispensed in a conventional manner into a product-receiving tray or trough 42 accessible from the exterior. The right side (unnumbered) of the outer frame member 22, as received from the exterior (FIG. 1), includes such conventional structures as a slot 43 for coins/tokens, a product/article selection pad or push buttons 44, a return coin receptacle 45, etc. Suitable wiring 46 (FIG. 3) connects the conventional dispensing mechanism (not shown) of the cabinet 30 to the push buttons 44 through an associated coin/token acceptor (not shown), etc. Four metal plates 52 through 55 are welded to the plate or outer frame 22 by welds 58 and to each of the flanges 28 of the respective angle iron members 23 through 26. The metal plates 52 through 55 are first welded to the outer plate 22, are telescoped into the inner frame member 21, and the frame members 21, 22 are then forcefully urged towards each other to forcefully engage therebetween the wall W by intimately contacting the inner and outer surfaces Si and So, respectively. During the latter, appropriate welds are made along the edges of the metal plates 52 through 55, as is indicated at 59 (FIGS. 5 through 8) to rigidly unite the frame members 21, 22 together to form the rigid frame 20.

Preferably, the opening 36 in the plate 22 is covered by an exterior panel of strong, tough, transparent polymeric/copolymeric plastic material, such as Lexon®, which is generally designated by the reference numeral 62. The Lexon® panel 62 is outboard of a strong, tough, metallic mesh panel 63 with each of the panels 62, 63 having aligned openings through which high-strength rivets 64 pass and are secured to narrow metal plates or bars 72 through 75 disposed respectively adjacent and parallel to the metal plates 52 through 55. The Lexon® panel 62 backed by the metal mesh panel 63 permits the products P to be viewed therethrough, as is readily apparent in FIG. 1, but renders the cabinet 30 virtually impenetrable no matter the manual force applied thereto by a potential thief, as by a sledge hammer, an axe or the like.

Figure 4:
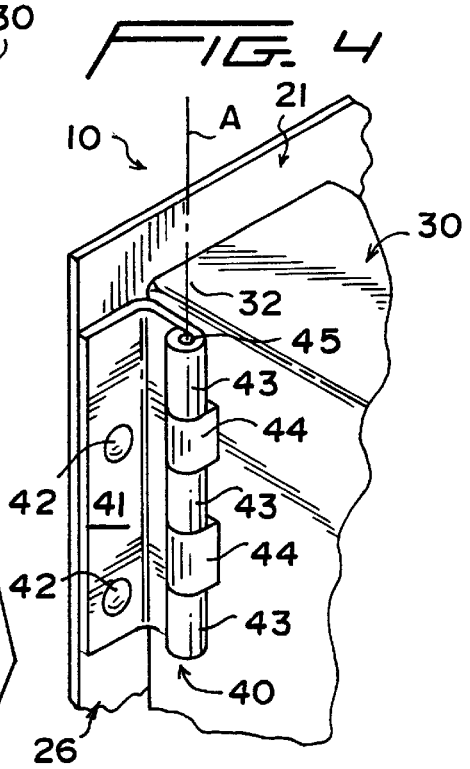
FIG. 4 is an enlarged fragmentary perspective view of an upper corner of the vending machine housing and the frame, and particularly illustrates one of two pivots associated therewith.

Referring specifically to FIG. 4, each of the pivots 40 include a plate 41 secured by rivets 42 to the flange 27 of the side angle iron member 26. The pivot plate 41 includes three journals or pintles of a tubular configuration which are generally designated by the reference numeral 43 and similar tubular journals or pintles 44 therebetween which are welded to the cabinet 30. A pivot pin 45 passes through the pintles 43, 42 of each of the pivots 40 to effect the pivotal connection of the cabinet 30 to the frame 20.

Figure 5:
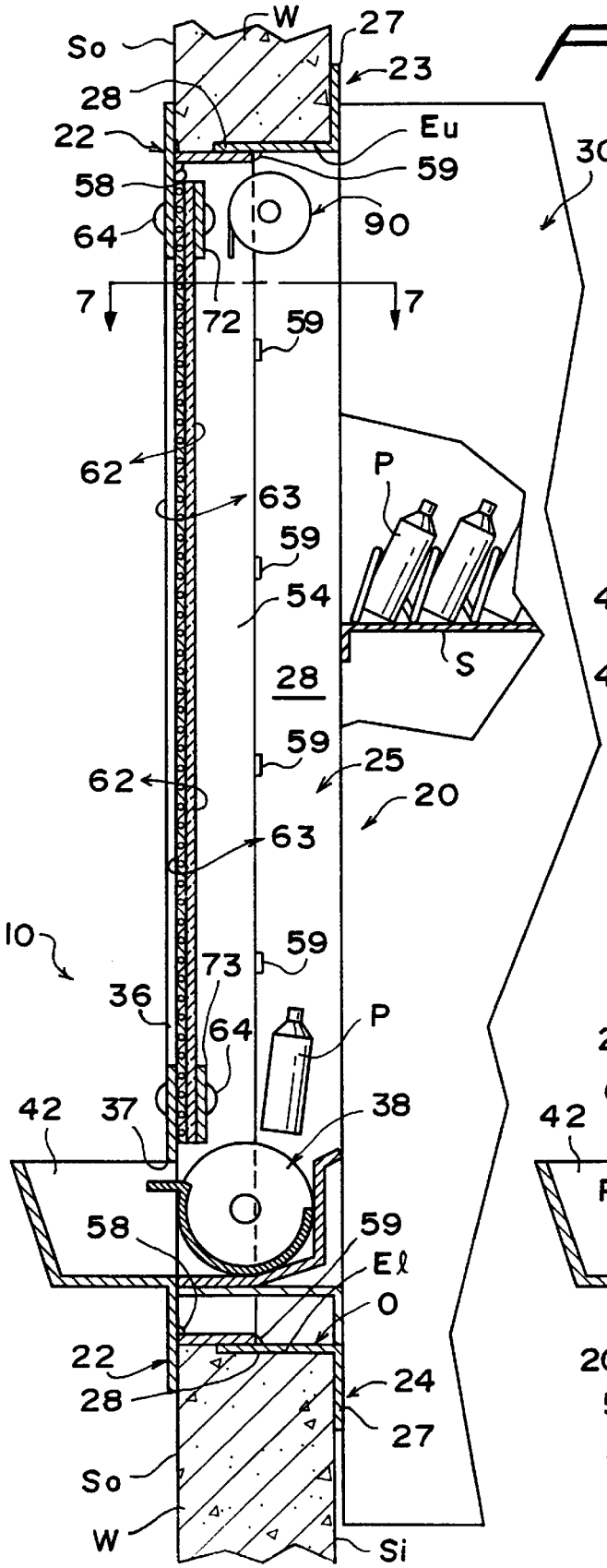
FIG. 5 is an enlarged cross-sectional view taken generally along line 5—5 of FIG. 1, and illustrates details of the frame and a product dispensing mechanism adjacent a product-receiving tray exteriorly the building wall.

Adjacent vertically disposed generally parallel panels 81, 82 (FIGS. 3, 7 and 8) are pivotally connected by respective pivots 83, 84 to the respective bars 75, 74 which function to guide the products P during their vertical descent from shelves S (FIG. 3) of the cabinet 30 into the dispensing roll 38, as is most readily apparent in FIG. 5. Additionally, the panel 81 can be pivoted by the pivot or pivot means 83 to a position essentially parallel to the panels 62, 63 when the cabinet 30 is in its open position (FIG. 3) to gain access to the cash/token box, the acceptor, etc. which are mounted on the inside surface of the front plate 22 along the illustrated right side edge (unnumbered) of FIG. 1.

A rolled privacy screen 90 (FIGS. 3 and 5) of a conventional construction is spring biased to its rolled condition (FIG. 3) but can be pulled down against the spring bias to totally close the opening 36 of the front frame member 22 and prevent viewing the interior of the cabinet 30 and the products P upon the shelves S when, for example, the vending machine 20 is not in use, as at night, or when the vending machine 30 has been opened (FIG. 3) for product loading, money/token removal, etc. The screen may be made of cloth or is preferably made of narrow, strong, tough metallic slats which not only prevent visibility through the opening 36 but add a further degree of protection to the overall vandal-proof vending machine.

Although a preferred embodiment of the invention has been specifically illustrated and described herein, it is to be understood that minor variations may be made in the apparatus without departing from the spirit and scope of the invention, as defined the appended claims.

I claim:

1. A vandal-proof vending machine comprising means for housing a plurality of articles adapted to be dispensed through a structural opening, means for dispensing said plurality of articles through a dispensing opening, means for defining a substantially rigid frame sized to be accommodated by and secured relative to a structural opening, means for rolling supporting said housing means relative to said frame, and means for pivotally securing said housing means to said frame for pivoting movement about a substantially vertical axis whereby said housing means can be rolled upon said rolling supporting means for rolling movement toward and away from said frame and an associated structural opening.

2. The vandal-proof vending machine as defined in claim 1 wherein said housing means includes first and second laterally spaced front edge portions, said frame includes first and second laterally spaced side edge portions, and said pivotally securing means pivotally secure said housing means first front edge portion to said first side edge portion.

3. The vandal-proof vending machine as defined in claim 1 wherein said housing means includes first and second laterally spaced front edge portions, said frame includes first and second laterally spaced side edge portions, said pivotally securing means pivotally secure said housing means first front edge portion to said first side edge portion, and means for releasably locking said housing means second front edge portion to said frame second side edge portion.

4. A vandal-proof vending machine comprising means for housing a plurality of articles adapted to be dispensed through a structural opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, a front plate having view opening means for viewing articles housed in said housing means, said dispensing opening being located in said front plate, means for securing said front plate to said frame, and means for preventing access to articles through said view opening means.

5. The vandal-proof vending machine as defined in claim 4 wherein said access preventing means is a tough strong panel of substantially unbreakable polymeric/copolymeric synthetic plastic material.

6. The vandal-proof vending machine as defined in claim 4 wherein said access preventing means is a trough strong screen of substantially unbreakable metallic material.

7. The vandal-proof vending machine as defined in claim 4 wherein said access preventing means is a tough strong panel of substantially unbreakable polymeric/copolymeric synthetic plastic material and a tough strong screen of substantially unbreakable metallic material.

8. The vandal-proof vending machine as defined in claim 4 wherein said access preventing means is a tough strong panel of substantially unbreakable polymeric/copolymeric synthetic plastic material, and a tough strong screen of substantially unbreakable metallic material with said metallic material being at least in part sandwiched between said panel and said frame.

9. A vandal-proof vending machine comprising means for housing a plurality of articles adapted to be dispensed through a structural opening means for dispensing said plurality of articles through a dispensing opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, and a roll of opaque material occupying a first rolled position substantially along an upper frame portion of said frame and a second unrolled position substantially covering an inner area delineated by said frame.

10. A vandal-proof vending machine comprising means for housing a plurality of articles adapted to be dispensed through a structural opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, said housing means includes first and second laterally spaced front edge portions, said frame includes first and second laterally spaced side edge portions, said pivotally securing means pivotally secure said housing means first front edge portion to said first side edge portion, a pair of laterally spaced first and second substantially vertically disposed panel means for guiding an article during the dispensing thereof from said housing means, a front plate having opening means for viewing articles housed in said housing means, means for securing said front plate to said frame, said frame includes first and second laterally spaced side edge portions, and first and second means for pivotally connecting said first and second panels to the respective first and second side edge portions of said frame.

11. A vandal-proof vending machine comprising means for housing a plurality of articles adapted to be dispensed through a structural opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, said housing means includes first and second laterally spaced front edge portions, said frame includes first and second laterally spaced side edge portions, said pivotally securing means pivotally secure said housing means first front edge portion to said first side edge portion, said frame includes first and second laterally spaced side edge angle members of a generally L-shaped transverse cross-sectional configuration and first and second vertically spaced respective upper and lower edge angle members of a generally L-shaped transverse cross-sectional configuration, each angle member including first and second flanges, and said first flanges being sized for close accommodation to an associated structural opening.

12. The vandal-proof vending machine as defined in claim 11 including a front plate having opening means for viewing articles housed in said housing means and being adapted to rest intimately against an exterior surface bounding an associated structural opening, and means for securing said front plate to said first flanges.

13. The vandal-proof vending machine as defined in claim 11 including a front plate having opening means for viewing articles housed in said housing means and being adapted to rest intimately against an exterior surface bounding an associated structural opening, and weld means for securing said front plate to said first flanges.

14. The vandal-proof vending machine as defined in claim 11 including a front plate having opening means for viewing articles housed in said housing means and being adapted to rest intimately against an exterior surface bounding an associated structural opening, and weld means for securing said front plate to said first flanges through an intermediate plate between said front plate and each first flange.

15. The vandal-proof vending machine as defined in claim 11 including a front plate having opening means for viewing articles housed in said housing means and being adapted to rest intimately against an exterior surface bounding an associated structural opening, and weld means for securing said front plate to said first flanges through an intermediate plate between and welded to said front plate and each first flange.

16. A vandal-proof vending machine comprising means for housing a plurality of articles adapted to be dispensed through a structural opening means for dispensing said plurality of articles through a dispensing opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, said housing means includes first and second laterally spaced front edge portions, said frame includes first and second laterally spaced side edge portions, said pivotally securing means pivotally secure said housing means first front edge portion to said first side edge portion, and means for releasably locking said housing means second front edge portion to said frame second side edge portion.

17. A vandal-proof vending machine comprising means for housing a plurality of articles adapted to be dispensed through a structural opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, said housing means includes first and second laterally spaced front edge portions, said frame includes first and second laterally spaced side edge portions, said pivotally securing means pivotally secure said housing means first front edge portion to said first side edge portion, a front plate having view opening means for viewing articles housed in said housing means, a dispensing opening being located in said front plate, means for securing said front plate to said frame, and means for preventing access to articles through said view opening means.

18. A vandal-proof vending machine comprising means for housing a plurality of articles adapted to be dispensed through a structural opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, said housing means includes first and second laterally spaced front edge portions, said frame includes first and second laterally spaced side edge portions, said pivotally securing means pivotally secure said housing means first front edge portion to said first side edge portion, a pair of laterally spaced first and second substantially vertically disposed panel means for guiding an article during the dispensing thereof from said housing means, a front plate having opening means for viewing articles housed in said housing means, means for securing said front plate to said frame, said frame includes first and second laterally spaced side edge portions, and first and second means for pivotally connecting said first and second panels to the respective first and second side edge portions of said frame.

19. A vandal-proof vending machine comprising means for housing a plurality of articles adapted to be dispensed through a structural opening, means for defining a substantially rigid frame sized to be accommodated by and secured relative to a structural opening, means for rolling supporting said housing means relative to said frame, means for pivotally securing said housing means to said frame for pivoting movement about a substantially vertical axis whereby said housing means can be rolled upon said rolling supporting means for rolling movement toward and away from said frame and an associated structural opening, said housing means includes first and second laterally spaced front edge portions, said frame includes first and second laterally spaced side edge portions, said pivotally securing means pivotally secure said housing means first front edge portion to said first side edge portion, said frame includes first and second laterally spaced side edge angle members of a generally L-shaped transverse cross-sectional configuration and first and second vertically spaced respective upper and lower edge angle members of a generally L-shaped transverse cross-sectional configuration, each angle member including first and second flanges, and said first flanges being sized for close accommodation to an associated structural opening.

20. The vandal-proof vending machine as defined in claim 19 including a front plate having opening means for viewing articles housed in said housing means and being adapted to rest intimately against an exterior surface bounding an associated structural opening, and means for securing said front plate to said first flanges.

21. The vandal-proof vending machine as defined in claim 16 including a front plate having view opening means for viewing articles housed in said housing means, a dispensing opening being located in said front plate, means for securing said front plate to said frame, and means for preventing access to articles through said view opening means.

22. The vandal-proof vending machine as defined in claim 16 including a pair of laterally spaced first and second substantially vertically disposed panel means for guiding an article during the dispensing thereof from said housing means, a front plate having opening means for viewing articles housed in said housing means, means for securing said front plate to said frame, said frame includes first and second laterally spaced side edge portions, and first and second means for pivotally connecting said first and second panels to the respective first and second side edge portions of said frame.

23. The vandal-proof vending machine as defined in claim 16 wherein said frame includes first and second laterally spaced side edge angle members of a generally L-shaped transverse cross-sectional configuration and first and second vertically spaced respective upper and lower edge angle members of a generally L-shaped transverse cross-sectional configuration, each angle member including first and second flanges, and said first flanges being sized for close accommodation to an associated structural opening.

24. The vandal-proof vending machine as defined in claim 16 wherein said frame includes first and second laterally spaced side edge angle members of a generally L-shaped transverse cross-sectional configuration and first and second vertically spaced respective upper and lower edge angle members of a generally L-shaped transverse cross-sectional configuration, each angle member including first and second flanges, said first flanges being sized for close accommodation to an associated structural opening, a front plate having opening means for viewing articles housed in said housing means and being adapted to rest intimately against an exterior surface bounding an associated structural opening, and means for securing said front plate to said first flanges.

25. A wall and vending machine combination comprising a substantially upright wall, an opening in said upright wall, said opening being of a generally polygonal configuration paid wall having opposite first and second wall surfaces through which said opening opens, a frame of a configuration corresponding to the polygonal configuration of said opening, said frame including first and second frame members being at least in partially overlying relationship to said respective first and second wall surfaces, a vending machine, means for rollingly supporting said vending machine, and means for pivotally connecting a first front lateral edge portion of said vending machine to the first of said first and second frame members for pivoting movement about a substantially vertical axis whereby said vending machine can be rolled upon said rolling supporting means for rolling movement toward and away from said frame and said opening.

26. The combination as defined in claim 25 wherein said vending machine includes a second front lateral edge portion spaced from and generally parallel to said first front lateral edge portion, and means for releasably locking said vending machine second front lateral edge portion to said first frame member.

27. The combination as defined in claim 26 wherein said pivotally connecting means and said releasably locking means are located at laterally opposite sides of said frame and said vending machine.

28. The combination as defined in claim 27 wherein said frame includes an opening for viewing articles housed in said vending machine, and means for preventing access to articles through said frame opening.

29. The combination as defined in claim 27 wherein said frame includes an opening for viewing articles housed in said vending machine, means for preventing access to articles through said frame opening, and said access preventing means is a tough strong panel of substantially unbreakable polymeric/copolymeric synthetic plastic material.

30. The combination as defined in claim 27 wherein said frame includes an opening for viewing articles housed in said vending machine, means for preventing access to articles through said frame opening, and said access preventing means is a trough strong screen of substantially unbreakable metallic material.

31. The combination as defined in claim 27 wherein said frame includes an opening for viewing articles housed in said vending machine, means for preventing access to articles through said frame opening, and said access preventing means is a tough strong panel of substantially unbreakable polymeric/copolymeric synthetic plastic material and a tough strong screen of substantially unbreakable metallic material.

32. The combination as defined in claim 27 including weld means for securing said first and second frame members to each other.

33. A wall and vending machine combination comprising a substantially upright wall, an opening in said upright wall, a frame of a configuration corresponding to the configuration of said opening, a vending machine means for dispensing articles from said vending machine, means for rollingly supporting said vending machine, and means for movably connecting said vending machine to said upright wall for rolling movement of said vending machine toward and away from said frame and said opening.

34. The combination as defined in claim 33 wherein said movably connecting means are pivot means for pivotally connecting adjacent lateral edge portions of said vending machine and said upright wall adjacent said opening to each other.

35. The combination as defined in claim 34 including means for releasably locking said vending machine to said upright wall remote from said pivot means.

36. The combination as defined in claim 35 wherein said pivot means and said releasably locking means are located at laterally opposite sides of said opening and said vending machine.

37. The combination as defined in claim 34 including a frame member secured to said opening, said pivot means pivotally connect said vending machine to said frame member, said frame member includes an opening for viewing articles housed in said vending machine, and means for preventing access to articles through said frame member opening.

38. The combination as defined in claim 37 wherein said access preventing means is a tough strong panel of substantially unbreakable polymeric/copolymeric synthetic plastic material.

39. The combination as defined in claim 37 wherein said access preventing means is a tough strong screen of substantially unbreakable metallic material.

40. The combination as defined in claim 37 wherein said access preventing means is a tough strong panel of substantially unbreakable polymeric/copolymeric synthetic plastic material and a tough strong screen of substantially unbreakable metallic material.

* * * * *